United States Patent [19]

Konnan

[11] 4,184,231

[45] Jan. 22, 1980

[54] FOUR IN HAND NECKTIE WITH INTEGRAL CLASP

[76] Inventor: Yehuda A. Konnan, 407 Marlin Dr., North Palm Beach, Fla. 33408

[21] Appl. No.: 814,266

[22] Filed: Jul. 11, 1977

[51] Int. Cl.[2] ..... A41D 25/10

[52] U.S. Cl. ..... 24/49 R; 24/49 CC; 24/49 CF; 2/145

[58] Field of Search ..... 24/49 R, 49; 2/145

[56] References Cited

U.S. PATENT DOCUMENTS

| | | | |
|---|---|---|---|
| 1,380,459 | 6/1921 | Youngs | 24/49 CP |
| 1,764,705 | 6/1930 | Ward | 2/145 |
| 2,025,441 | 12/1935 | Cohn | 24/49 CF |
| 2,084,503 | 6/1937 | Rogers | 24/49 CF |
| 2,586,215 | 2/1952 | Federico | 24/49 CC |
| 3,968,544 | 7/1976 | Sinclair | 24/49 CF |

FOREIGN PATENT DOCUMENTS

| | | | |
|---|---|---|---|
| 658489 | 4/1938 | Fed. Rep. of Germany | 2/145 |
| 792342 | 12/1935 | France | 24/49 CC |
| 233436 | 5/1925 | United Kingdom | 24/49 CC |

*Primary Examiner*—Victor N. Sakran
*Attorney, Agent, or Firm*—Malin & Haley

[57] ABSTRACT

A four in hand necktie with a permanently attached clasp for removably attaching the tie to the edge of a shirt opening. The holder is made of a first horizontal flexible member made of a ribbon, a wide ribbon, a card, or a chain and is attached permanently to the back of the front pendant of a necktie. A second member, made of a short length of cord or chain that is permanently connected to the first horizontal member in the middle of horizontal member or is movably connected to the first member through a ring which allows the second member to move along the first horizontal member. The distal end of the second member is connected to a clamp. The clamp is used to clasp the edge of a shirt opening when the necktie is being worn by a person. When the necktie is removed, the clamp is connectable to the edge of the necktie.

The tie holder is permanently attached to the necktie, it is fully concealed and does not interfere with a user when he puts on the necktie or takes off the necktie. The tie holder is fully safe and allows a moderate vertical movement of the necktie. The first horizontal member also serves to keep the back pendant of the necktie together with the front pendant.

2 Claims, 16 Drawing Figures

FOUR IN HAND NECKTIE WITH INTEGRAL CLASP

BACKGROUND OF THE INVENTION

It is a well known fact to people who wear the common four in hand neckties that the dangling pendants of the neckties tend to move around, usually in swinging motions, due to the person's movement or due to winds or breezes, etc. These movements of the neckties are bothersome to most people in a number of ways. They may make a person look untidily dressed, the neckties can touch food or drinks when sitting down or getting up in front of tables with food or beverages on them. Neckties which are free to move around can even be dangerous in industry, for instance, loose neckties may be caught in dangerous machinery. Altogether the free movement of the pendants of neckties is a nuisance to a large number of people. Prior art devices used to attach neckties to the front portion of shirts are desirable to many people and they are generally called "Tie Clasps."

In the market place there are two well known types of tie clasps commonly available. One is commonly known as a "tie clasp" and is shown in FIG. 1. This tie clasp is very easy to use and is effective. It has a disadvantage of preventing a slight vertical movement of the necktie, which is necessitated by some of the body movements of a person, such as sitting down or throwing one's head back. Some people do not like to use this type of tie clasp because it attaches the pendants rigidly to the shirt. Because of that, the necktie cannot be moved even slightly, which many people dislike or find uncomfortable.

The other commonly used device is usually called a "tie tack" and is shown in FIG. 2. The tie tack is more awkward to use than the tie clasp described above because it is often difficult to pierce the tie with the pin. It also has other disadvantages, some of which are: (a) One of its two parts can be lost; (b) the piercing of the tie can damage the tie. Many people prefer the tie tack because the chain allows a slight free movement of the tie and eliminates discomfort due to the vertical movement of the necktie when the user moves.

Both the tie clasp and the tie tack are not attached permanently to either the necktie or to the shirt and can be easily lost or require the user to look for the item before use. Having to look for such items is bothersome to many people since they are small in size and can be easily misplaced. In fact many people will frequently lose them. Also the two devices referred to in FIGS. 1 and 2 are visible from the front of the necktie and usually have to be adorned by jewelry like adornments which make them expensive compared to non-adorned devices.

U.S. Pat. No. 3,968,544 was issued to James Sinclair. This invention is essentially a large safety pin with a chain connected to one arm of the safety pin-like member and the other side is connected to a cross bar which is dropped into a buttonhole. This invention has a number of disadvantages compared to the invention disclosed and claimed herein and these disadvantages are:

1. When used as a permanent fixture connected to a necktie the large inflexible metal safety pin-like part will interfere with the knot of the common four-in-hand necktie when passing the front pendant through the knot which is done each time the necktie is put on or taken off.

2. As a permanent attachment to the necktie, the chain and crossbar can also make it awkward to pass the front pendant through the knot, the chain and crossbar can snag in the knot.

3. The permanent attachment cannot be permanently attached to a necktie because the cross bar may not be able to reach a buttonhole each time it is used. This can be overcome by making the chain as long, or longer, than the middle distance between two holes in shirts. But if that is done, the chain may cause the loss of the prime purpose of the tie clasp which is keeping the necktie close to the shirt.

4. In some instances having to use a buttonhole prevents vertical movement of the necktie in one direction. This is illustrated in FIG. 3. If the distance A from the member attached to the front pendant to the buttonhole equals to the length of the chain the necktie will be unable to move vertically upward. Such a movement is necessary for comfort for example, when a person throws his head back. In the case shown in FIG. 4 the necktie cannot move vertically down and the lack of such a movement can make the necktie bulge forward which many people dislike from an aesthetic point of view.

5. The space between the two arms of the safety pin like member has to be narrow in order to make it concealable. This narrow opening makes it awkward to push the back pendant through.

Another prior patent is U.S. Pat. No. 2,586,215 issued to Frederico. The differences between this patent and the present invention, if used as a permanent fixture, are:

1. This tie clasp is not concealable as the two side clips that are attached to the chain are visible from the front of the front pendant.

2. In order to allow vertical movement of the necktie, the chain has to be loose, i.e., its length has to be greater than the straight line distance between the two clips attaching it to the front pendant. In this case it does not serve as a means to keep the front and back pendants together.

3. Due to the fixed length of the chain between the two clips the distance the tie can move away from the shirt or the distance the tie can move in a vertical direction depends on the width of the front pendant. In the case of a narrow design necktie the necktie will move too far out. With very wide design neckties the length of the chain may not be enough to allow any vertical movement of the necktie without bending the necktie out of its normal flat shape. For the same reason the necktie will not be able to move around slightly, many people like to have their neckties move slightly. In the extreme case, for very wide necktie designs, the chain may not be long enough to allow attaching the clips to the edges of the front pendant.

In prior U.S. Pat. No. 3,116,525 issued to W. A. Kolby the disadvantages compared to the present invention, if used as a permanent fixture, are:

1. The cleats on the pins for attaching the tie clasp to the front pendant are not safe, the user can prick his fingers when attaching them to the tie or taking them out of the necktie.

2. No vertical movement of the necktie appears possible if this tie clasp keeps the fron and back pendants close together as is claimed.

SUMMARY OF THE INVENTION

This invention is a four in hand necktie with a clasp permanently attached to the back of the front pendant of the necktie for sale as an inseparable part of the necktie. The tie holder comprises three main parts, first, a horizontal attaching member which is flexible and permanently attached at each of its ends to the back of the front pendant, at a vertical height about midway between the knot and the lower end of the front pendant or any other level in between, second, a connecting member with one end permanently or movably connected to the first attaching member by stitches, etc. or a sliding ring, and third, a clamp connected to the distal end to the second member.

The connecting means for the first attaching member to attach it permanently to the back folds of its front pendant can be made by many alternative methods, such as adhesive bonding, direct stitching, the use of a connectable loop or a connectable ring, or any other way forming a flat, non-bulky connection. The horizontal attaching member can be a wide or narrow string member, a string member, a metal chain, a heavy plastic fiber, a ribbon, or any other flexible material capable of being affixed to the cloth material of a four-in-hand tie. The second connecting member can be of a similar material.

The tie clamp is of the known type having a V-shaped metal part with two arms and a lever that is pivoted at a midpoint on the end of the first arm about a pin. One free end of the lever is biased against the other arm of V-shaped metal part. The biasing is formed by a wound spring member positioned around the pin with one end pressing against the end of lever and the other end against the cooperating first arm V-shaped metal part. Other biasing means can be used.

It is an object of this invention to provide a tie holder in the combination that attaches the pendants of a necktie to the edge of the shirt at any convenient level that the tie clasp happens to be after putting on the necktie.

It is another object of the tie holder-necktie combination of the present invention to provide a permanent attachment to the four-in-hand, a necktie, which means that there is no need to look or locate a tie clasp and prevents loss of the tie holder.

It is another object to fully conceal the tie holder in a combination of a four-in-hand and a tie holder when wearing the tie in the normal way.

It is another object to provide a tie holder in the combination that does not interfere with or make it difficult to put on or take off the necktie with the attached tie holder.

It is another object to provide a tie holder-necktie combination that is fully safe for use.

It is another object of this invention to provide a tie holder-necktie combination that allows slight moving around of the necktie including vertical movement.

It is another object of this invention to provide a tie holder-necktie combination that keeps the front and back pendants of the four-in-hand together.

It is an additional object of this invention to provide a tie holder-necktie combination that is simple and easy to manufacture.

The above properties of the invention overcome disadvantages of prior art tie clasps, used preferably as permanent fixtures, none of which has all the above properties.

DESCRIPTION OF PREFERRED EMBODIMENTS OF A TIE CLASP

Figure 1:
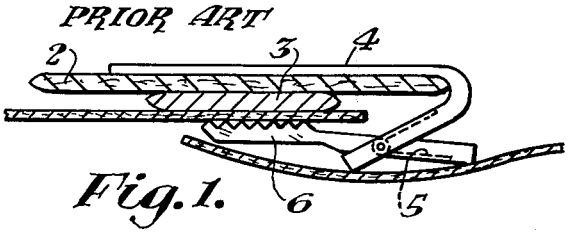
FIG. 1 is a top view of a prior art tie clasp and a tie and shirt in cross section.

The prior art devices are shown in FIGS. 1, 2, 3 and 4. FIG. 1 shows the cross section of wearer's shirt, the front pendant of necktie 2, the back pendant of necktie 3, the front part of tie clasp 4, the spring 5 and the clamping arm of tie clasp 6. The necktie is clamped to the wearer's shirt.

Figure 2:
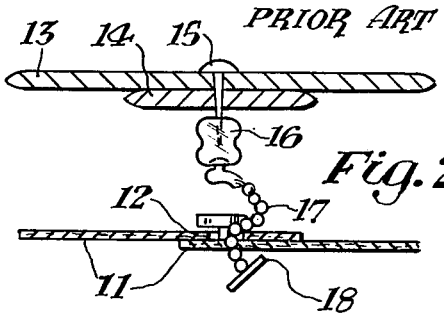
FIG. 2 is a top view of a prior art tie tack and a tie and shirt in cross section.

FIG. 2 shows the cross section of wearer's shirt 11, the button passed through buttonhole 12, the front pendant of necktie 13, the back pendant of necktie 14, the tie clasp tack piercing necktie 15, the tie tack holder 16, the chain 17 of tie clasp passing through buttonhole 12, and the cross bar 18 of tie clasp under shirt.

Figure 3:
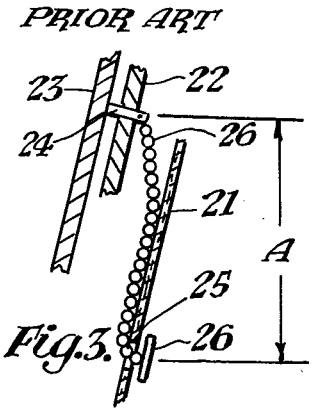
FIG. 3 is a side view of a prior art tie clasp and a shirt and tie in cross section with tie upwards movement restricted.

FIG. 3 shows the cross section of wearer's shirt 21, the cross section of back pendant of necktie 22, the cross section of front pendant of necktie 23, the member attaching to front pendant 24, the chain of tie clasp passing through buttonhole 25, and the crossbar at end of clasp chain 26.

Figure 4:
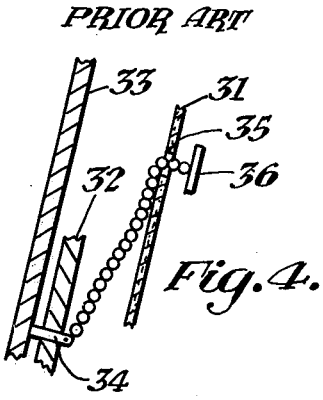
FIG. 4 is a side view of a prior tie clasp and a shirt and tie in cross section same as FIG. 3 with tie downwards movement restricted.

FIG. 4 shows the cross section of wearer's shirt 31, the cross section of back pendant of necktie 32, the cross section of front pendant of necktie 33, the member attaching to front pendant 34, the chain of tie clasp 35 passing through buttonhole and the crossbar at end of clasp chain 36.

Figure 5:
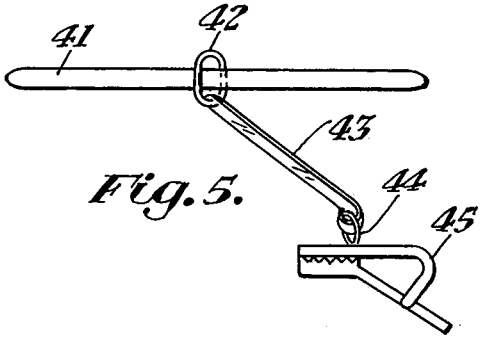
FIG. 5 is a top view of the first embodiment of the invention not attached to either a necktie or a shirt.
Figure 6:
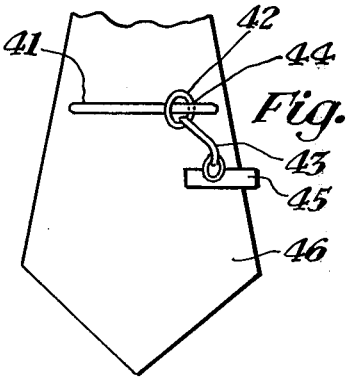
FIG. 6 is a rear view of a front pendant of a four-in-hand tie with the first embodiment of the tie holder permanently attached to it when the necktie is not being worn.
Figure 7:
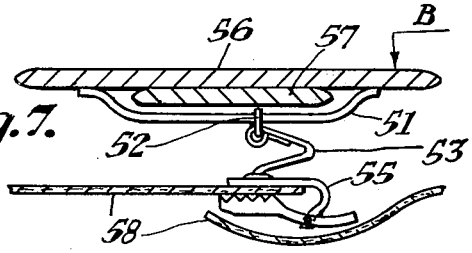
FIG. 7 is a top view with the necktie and a shirt in cross section when the necktie is being worn showing the tie holder holding the front and back pendants together and attaching them to the shirt.

Referring to FIG. 5 showing the first embodiment of the invention by itself, and to FIG. 6 showing the tie holder attached to the back of the front pendant of a necktie (a four-in-hand) when it is not worn, and to FIG. 7 showing the invention in a horizontal cross section when the necktie is being worn by a person, the first embodiment of the invention is made of four essential parts shown in FIGS. 5 and 6:

(a) a four-in-hand (a necktie),
(b) a horizontal attaching member 41 which is highly flexible,
(c) a connecting member 43 which is also highly flexible and is connected on one side to attaching member 41, through a sliding ring 42, and on its other side to the third part of the tie clasp which is clamp 45, and
(d) clamp 45 makes it possible to attach the holder to the edge of fabric or a shirt, clamp 45 may be made of metal and is connected to connecting member 43 by attaching ring 44.

Referring to FIG. 6 showing a rear view of the front pendant of a necktie 46 with the first embodiment of the invented, the combination necktie and tie holder or clasp are permanently attached to one another. The attaching member 41 is attached at its ends to the backfold of the front pendant. This attachment can be done by any of many alternative methods such as fabric to fabric adhesive bonding (see B of FIG. 7), direct stitching, stitching of a loop or a ring (see detail 83 of FIG. 10), or any other way which gives a safe non bulky bonding. In FIG. 6, the ring 42 is connected between the attaching member 41 and connecting member 43. The ring is pushed towards the right side of attaching member 41, and the clamp 45 is attached to the edge of the front pendant in such a way that it does not protrude out. This configuration makes it possible to put the necktie on or take off the necktie with the permanently connected holding means including attaching member, connecting member and the clasp not interferring with the process, especially the construction of the slip knot.

In FIG. 7 is a cross section view taken through the necktie, the shirt and a view of the tie holder with the clasp when the necktie is being worn. Ring 52 is positioned at about the middle of attaching member 51 and clamp 55 is attached to the edge of shirt 58. Clamp 55 is transferred from the edge of the front pendant to the position shown after the necktie is placed in use. The back pendant 57 is inserted between attaching member 51 and front pendant 56. The front and back pendants are held together in this manner. Before the necktie is taken off, clamp 55 is transferred back to the edge of the front pendant as shown in FIG. 6. Next the necktie can be taken off like any other necktie that does not have anything attached to it.

Figure 8:
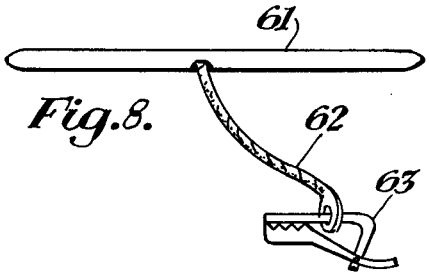
FIG. 8 is a top view of a first alternative configuration of the tie holder.

An alternative design is shown in FIG. 8 where connecting member 62 is attached rigidly, in any of many possible ways as set forth above, to the middle of attaching member 61. The configuration of FIG. 8 will work with narrow neckties without having to make connecting member 62 so long that its function of holding the necktie close to the shirt is compromised.

In the arrangement shown in FIGS. 5, 6 and 7, the sliding ring 42 and 52 are functional because of its movement towards the edge of the necktie. This allows a relatively short length connecting members 43 and 53 and makes it possible to attach clamps 45 and 55 to the edges of wide neckties.

Figure 9:
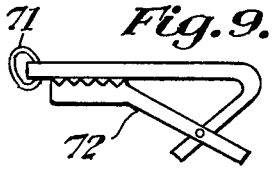
FIG. 9 is a view of a ring attachment to the clamp member of the tie holder.

FIGS. 5 and 9 show a feature of the invention that further fascilitates in attaching clamps 45 and 72 to the edge of wide neckties. The feature is the location on the clamp member of the ring that connects it to the connecting member. FIG. 9 shows the clamp 72 with connecting ring 71. By locating ring 71 near the edge of the clamp 72 opening, less siding movement of the connecting member is needed when attaching the clamp to the edge of the side of the pendant. On the other hand, this feature allows use of this tie clasp for very wide ties. This feature can be seen in FIG. 6 at 45.

The invention as shown in FIG. 6 is a four-in-hand necktie with a permanent attachment of a clasp and as such is designed so that it does not interfere with the necktie when it is put on or taken off. To assure proper use of the attaching member and the connecting member, both have to be as flexible as the necktie itself. Fabric ribbon, cord, or jewelry chains are flexible enough for this purpose. Also the clamp is small enough in size to go through the knot of a four in hand necktie when the necktie is being put on or taken off. Clamps of the construction shown in FIG. 5 which are small enough for this purpose are presently available in the market place.

Slight movement about of the necktie and vertical movements of the necktie are made possible by attaching clamp 55, as shown in FIG. 7, to the shirt at the same level as attaching member 51 and the connecting member 53 has the length as shown in FIG. 7. This is possible because clamp 55 in FIG. 7 can be attached to the edge of the shirt at any place along this edge and does not have to be limited to a location such as a buttonhole.

Figure 10:
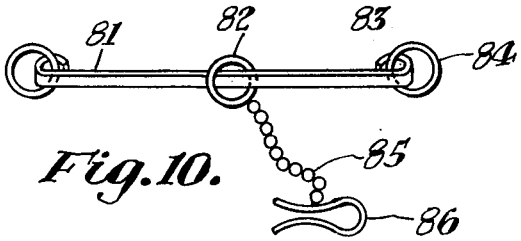
FIG. 10 is the view of a second alternative configuration of the tie holder.
Figure 11:
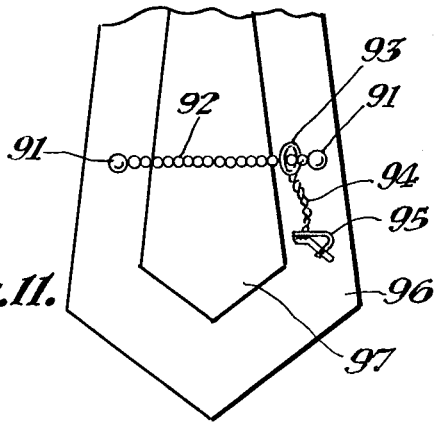
FIG. 11 is a rear view of a third alternative configuration of the tie holder which is attached to the back of a front pendant. The back pendant is held between the tie holder and the front pendant and the clamp is not attached to either a shirt or the edge of a front pendant.
Figure 12:
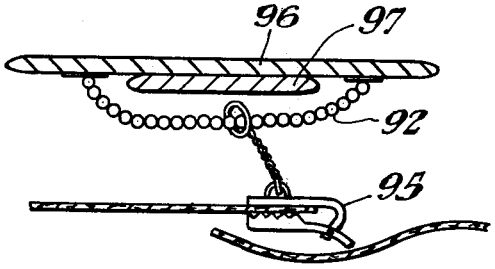
FIG. 12 is the top view of FIG. 11 with the tie and shirt in cross section and the clamp attached to the edge of a shirt.

Alternative details of the three parts that comprise the invention are shown in FIGS. 10, 11 and 12. FIG. 10 shows additional alternative configuration of the invention by itself. Attaching member 81 is folded over at its end to form a closed loop. In this configuration the attaching member can be stitched to the backfold of the front pendant using a loop. Alternatively, a metal ring 84 can be passed through the loop and the stitching can be done through the ring. Another alternative is to attach a metal ring 84 to a tab that is attached to the backfold of the front pendant. Such a tab is shown as part 91 in FIG. 11 which shows another alternative configuration of the tie clasp that is attached to the back of the front pendant. The tab has to be attached firmly to the pendant in order to be flat and small enough to go through the knot of the necktie when the tie knot is made or taken apart. In FIG. 10, the connecting member 85 is a jewelry chain, and clamp 86 is a modified C clamp that is made of spring material.

The clamp, 45 in FIG. 5, can be any device that will attach firmly to the edge of fabric. At the same time the clamp has to be small enough to go through the necktie knot. Even a smallish safety pin could be used for this purpose.

In FIG. 11, showing a view of the back of the front pendant of a necktie with an alternative configuration. In this configuration the attaching and connecting members are made of jewelry chains. The attaching member 92 is connected to the backfold of the pendant with the help of tabs 91 which are discussed herein above. The back pendant 97 is shown inserted between the front pendant 96 and attaching member 92 while clamp 95 hangs freely therefrom. For this configuration, clamp 95 would be attached to the edge of the shirt. The design of the tab in FIG. 11 can be of a great variety of shapes as long as it is safe and holds firmly to the pendant and is small enough to go through the knot of the necktie. Such a tab could be, among other things, a miniature safety pin.

Figure 13:
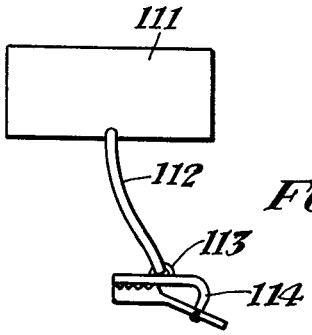
FIG. 13 is a view of a fourth alternate design of the tie holder-necktie combination when it is not attached to a necktie or a shirt.

An alternate design of the invention is shown in FIGS. 13, 14, 15 and 16. This alternate design has all the properties of the main design and may be a simpler and less expensive to manufacture. FIG. 13 shows the alternate design by itself. An attaching member 111 is a ribbon made of fabric. Attached to the middle of attaching member 111 is a connecting member 112, the attaching may be done by any convenient means. The connecting member 112 can be made of a narrow ribbon, or cord or of jewelry chain. Attached to the other end of connecting member 112 is a clamp 114. A ring 113 is connected between the member 112 and clamp 114.

Figure 16:
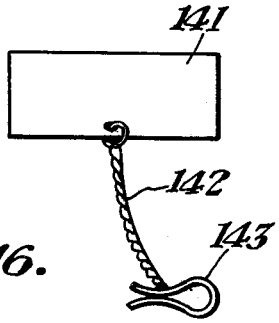
FIG. 16 is the view of a fifth configuration of the alternate design tie holder shown in FIG. 13.

FIG. 16 shows alternate design, the connecting member 142 is a jewelry chain and the clamp 143 is a C shaped clamp made of spring material.

Figure 14:
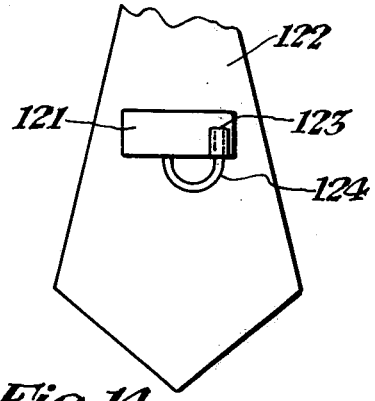
FIG. 14 is a rear view of the tie holder shown in FIG. 13 attached to the back of a front pendant of a necktie when the necktie is not being worn.
Figure 15:
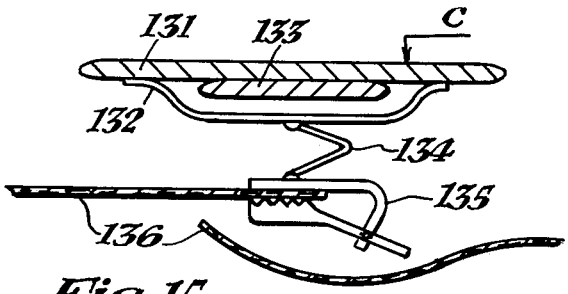
FIG. 15 is a cross section of the alternate of FIG. 14 with the clamp attached to the edge of a shirt.

FIG. 14 shows the alternate design attached to the rear of the front pendant of a necktie when the holder and tie are not being worn. Attaching member 121 is connected to the backfold of the front pendant 122 by adhesive bonding, stitching or any other convenient means. Detail C in FIG. 15 shows adhesive bonding. Clamp 123 is now attached to the ribbon of attaching member 121 in FIG. 14. FIG. 14 also shows necktie that can be put on or taken off with no interferrence by the parts of the holding means with knot making or undoing the knot of the tie.

FIG. 15 shows a cross section through the necktie, the attaching member and the shirt when the necktie is being worn. The front pendant 131 and the back pendant 133 are held together with the help of attaching member 132. Clamp 135 holds the two pendants close to the shirt with the help of connecting member 134 and attaching member 132. After putting on the necktie the clamp is removed from attaching member 132, (which is the situation as shown in FIG. 14) and is attached to the edge of the shirt 136. When taking off the necktie the clamp is transferred back and attached to attaching member 132. The attaching member and the connecting member have to be as flexible as the necktie. Also the ribbon attaching member (121 in FIG. 14) has to be wide enough so that the clamp (123 in FIG. 14) can be attached to it safely. As for the other properties of this alternate design of the tie-holder combination they are the same as set forth above.

The instant invention has been shown and described herein in what is considered to be the most practical and preferred embodiment. It is recognized, however, that departures may be made therefrom within the scope of the intention and that obvious modifications will occur to a person skilled in the art.

What is claimed is:

1. A four-in-hand necktie comprising:

a necktie clasp, a wide end portion having a front and back, a mid portion and a narrow end portion positioned along a longitudinal center line, and a wide holding ribbon having a front and back permanently fixed to said back of said wide end portion between the distal end of said wide end portion and said mid portion where the four-in-hand knot is located, said holding ribbon transversely positionable for holding said narrow end portion between said back of said holding ribbon and said back of said wide end portion when the four-in-hand knot is completed, said necktie clasp includes, an attaching means connected to said holding ribbon, a releasable concealed clamp means not visable from the front of the necktie, a relatively short, narrow, transversely flexible connecting means having one end permanently fixed to said attaching means and a second end permanently fixed to said clamp means, said connecting means of a length long enough for allowing head and body movement of the tie wearer when said clamp means is connected to a shirt, and said connecting means of a length short enough for holding said four-in-hand necktie close to the shirt when the tie wearer bends over, said second end moveable above, below and away from said one end, said clamp means for removably connecting said necktie clasp to a shirt at the approximately same vertical position of said attaching means on said holding ribbon when the user's head, neck and upper trunk is positioned in a normal mid upright position for allowing movement of said necktie and holding ribbon directly away from and vertically up and down from said position of said clamp means on the shirt a distance equal to the length of said connecting means for freedom of movement of the user, said connecting means having a length that is just long enough to allow full movement of the user's head, neck and upper trunk from a forward head down position to a rearward head up position without placing said connection means in tension, said clamp sized and shaped to be attachable to said holding ribbon without interfering with the four-in-hand knot while putting it on, taking it off, and tying or untying the four-in-hand knot, said necktie clasp sized and shaped to allow the four-in-hand knot to be tied and untied without removal of said necktie clasp and without interferring with the four-in-hand knot while putting on and taking off the four-in-hand necktie with said clamp means attached to said holding ribbon.

2. A four-in-hand necktie as set forth in claim 1, wherein:

said attaching means is permanently connected at a point to said holding ribbon.

* * * * *

UNITED STATES PATENT OFFICE

CERTIFICATE OF CORRECTION

PATENT NO. : 4,184,231

DATED : January 22, 1980

INVENTOR(S) : Mr. Yehuda A. Konnan

It is certified that error appears in the above-identified patent and that said Letters Patent are hereby corrected as shown below:

Column 2, line 67 delete "fron" and insert -- front--

Column 4, line 62 after "under" insert --the--

Column 7, line 32 after "interference" insert --,--

Column 7, line 33 after "means" insert --,--

Column 8, line 17 delete "visable" and insert --visible--

Signed and Sealed this

*Third* Day of *June 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,184,231

DATED : January 22, 1980

INVENTOR(S) : Mr. Yehuda A. Konnan

It is certified that error appears in the above—identified patent and that said Letters Patent is hereby corrected as shown below:

Page one, left column, line 3, delete "Dr." and insert --road--.

Signed and Sealed this

*Seventeenth* Day of *November 1981*

[SEAL]

*Attest:*

GERALD J. MOSSINGHOFF

*Attesting Officer*

*Commissioner of Patents and Trademarks*